US008398002B2

(12) United States Patent
Kagami et al.

(10) Patent No.: US 8,398,002 B2
(45) Date of Patent: Mar. 19, 2013

(54) FUEL INJECTION DEVICE

(75) Inventors: Shu Kagami, Nagoya (JP); Jun Kondo, Nagoya (JP); Tomoki Fujino, Okazaki (JP)

(73) Assignee: Denso Corporation, Kariya (JP)

( * ) Notice: Subject to any disclaimer, the term of this patent is extended or adjusted under 35 U.S.C. 154(b) by 386 days.

(21) Appl. No.: 12/753,351

(22) Filed: Apr. 2, 2010

(65) Prior Publication Data

US 2010/0252650 A1 Oct. 7, 2010

(30) Foreign Application Priority Data

Apr. 3, 2009 (JP) ..... 2009-90702

(51) Int. Cl.

| | |
|---|---|
| ***F02M 47/02*** | (2006.01) |
| ***F02M 51/00*** | (2006.01) |
| ***B05B 1/30*** | (2006.01) |
| ***H02G 3/18*** | (2006.01) |
| ***H02G 3/06*** | (2006.01) |
| ***H02G 15/08*** | (2006.01) |
| ***H01R 4/00*** | (2006.01) |
| ***H01R 9/05*** | (2006.01) |
| ***H01R 4/24*** | (2006.01) |
| ***H01R 4/26*** | (2006.01) |
| ***H01R 11/20*** | (2006.01) |
| ***H01R 9/22*** | (2006.01) |

(52) U.S. Cl. ..... 239/88; 239/585.1; 174/650; 174/93; 439/719; 439/418; 439/582

(58) Field of Classification Search ..... 239/88, 239/585.1, 102.2; 174/650, 93; 439/719, 439/417, 418, 582

See application file for complete search history.

(56) References Cited

U.S. PATENT DOCUMENTS

| | | | | |
|---|---|---|---|---|
| 2,563,762 | A * | 8/1951 | Uline et al. | 439/279 |
| 4,472,012 | A * | 9/1984 | Michaels | 439/597 |
| 5,797,761 | A * | 8/1998 | Ring | 439/320 |
| 7,097,484 | B2 * | 8/2006 | Schurz et al. | 439/279 |
| 7,394,184 | B2 * | 7/2008 | Plecher et al. | 310/340 |
| 2004/0074999 | A1 * | 4/2004 | Haag et al. | 239/585.1 |

FOREIGN PATENT DOCUMENTS

| | | |
|---|---|---|
| JP | 2007-278139 | * 10/2007 |
| JP | 2008-240544 | 10/2008 |

* cited by examiner

*Primary Examiner* — Len Tran
*Assistant Examiner* — Chee-Chong Lee
(74) *Attorney, Agent, or Firm* — Nixon & Vanderhye PC

(57) ABSTRACT

A fuel injection device includes a pressure control portion for controlling operation of a nozzle, and a body portion having therein a bent lead wire hole through which two lead wires of the pressure control portion are introduced to exterior. A first guide member having therein a pair of first guide grooves partitioned by a first partition member is inserted into the lead wire hole from one end side, a second guide member having therein a pair of second guide grooves partitioned by a second partition member is inserted into the lead wire hole from the other end side. The first partition member protrudes from one end portion of the first guide member to have a protrusion portion, which is fitted with a recess portion of the second partition portion at one end portion of the second guide member when the first and second guide members contact.

5 Claims, 3 Drawing Sheets

FUEL INJECTION DEVICE

CROSS REFERENCE TO RELATED APPLICATION

This application is based on Japanese Patent Application No. 2009-090702 filed on Apr. 3, 2009, the contents of which are incorporated herein by reference in its entirety.

FIELD OF THE INVENTION

The present invention relates to a fuel injection device for injecting fuel to an internal combustion engine, for example.

BACKGROUND OF THE INVENTION

Conventionally, JP 2008-240544A describes regarding a fuel injection device including a pressure control portion for controlling injection of fuel. The pressure control portion controls a pressure applied to a nozzle needle in accordance with an electrical signal input by an engine ECU, thereby controlling a nozzle opening and closing operation.

In the fuel injection device, a lead wire hole is provided in a body portion, so that two lead wires connected to the pressure control portion are introduced to exterior via the lead wire hole. A guide member having therein a pair of guide grooves is provided in the lead wire hole, so that the lead wires are guided to the exterior by using the guide member in the lead wire hole of the body portion.

However, in a case where the lead wire hole is bent in the body portion, if the guide member is difficult to be elastically deformed, it is difficult for the guide member to be inserted into the lead wire hole.

SUMMARY OF THE INVENTION

To overcome the above problems, the inventors of the present application use upper and lower two straight guide members 61, 62 as in a comparison example shown in FIG. 6. In the example of FIG. 6, the two straight guide members 61, 62 are respectively inserted from two end sides of a lead wire hole 18 so that end surfaces of the guide members 61, 62 contact at a bent portion of the lead wire hole 18. Thus, two lead wires, which are connected to a pressure control portion arranged below of the guide member 62, can be introduced to the exterior via a pair of guide grooves of the guide member 62 and a pair of guide grooves of the guide member 61.

However, because the contact end surfaces of the guide members 61, 62 are made in flat as in the example of FIG. 6, the lead wires from the lower guide member 62 may be incorrectly switched in the guide grooves at the contact portion between the lower guide member 62 and the upper guide member 61.

For example, when the lead wires are assembled, the upper guide member 61 is inserted into the lead wire hole 18, in first. Then, the lower guide member 62 is inserted in the lead wire hole 18 to contact the upper guide member 61 in a state where the lead wires are inserted into a midway position of the lower guide member 61, and the lead wires are further guided to the upper guide member 61. In this case, if the lead wires are further inserted in the lower guide member 62 toward the upper guide member 61, the lead wires may be incorrectly inserted in the guide grooves at the contact portion between the lower guide member 62 and the upper guide member 61. In addition, even if an error insertion of the lead wires is caused, it is difficult to distinguish the error insertion of the lead wires.

In view of the foregoing problems, it is an object of the present invention to prevent an error insertion of the lead wires at a contact portion between first and second guide members.

It is another object of the present invention to effectively reduce an error insertion of the lead wires at a contact portion between first and second guide members, and to easily distinguish an error insertion even when the error insertion is caused.

According to an aspect of the present invention, a fuel injection device includes a nozzle configured to inject high pressure fuel from injection holes, a pressure control portion configured to control operation of the nozzle in accordance with an electrical signal input from exterior, and a body portion having therein a lead wire hole through which two lead wires connected to the pressure control portion are introduced to the exterior. The lead wire hole has a bent portion at a midway position. Furthermore, a first guide member having therein a pair of first guide grooves extending in an axial direction of the first guide member is inserted into the lead wire hole from one end side of the lead wire hole, and a second guide member having therein a pair of second guide grooves extending in an axial direction of the second guide member is inserted into the lead wire hole from the other end side of the lead wire hole. In addition, a first partition member is provided in the first guide member to partition the first guide grooves from each other, and a second partition member is provided in the second guide member to partition the second guide grooves from each other. The first partition member protrudes from one end portion of the first guide member to have a protrusion portion, and the second partition member has a recess portion recessed from one end portion of the second guide member. In the fuel injection device, the protrusion portion of the first partition portion at the one end portion of the first guide member is fitted with the recess portion of the second partition portion at the one end portion of the second guide member so that the one end portion of the first guide member contacts the one end portion of the second guide member. Thus, the two lead wires connected to the pressure control portion can protrude to the exterior respectively via the first and second groove portions of the first and second guide members without causing an incorrect insertion at the contact portion. Furthermore, an error insertion can be easily distinguished because the one end portion of the first guide member contacts the one end portion of the second guide member.

For example, the first guide member may be located at a position far from the pressure control portion, and the second guide member may be located near the pressure control portion. In this case, a hole diameter of each first guide groove provided in the first guide member can be made larger than a hole diameter of each second guide groove provided in the second guide member. Thus, the lead wires can be smoothly inserted at the contact portion from the second guide member to the first guide member.

Furthermore, a first distinguishing portion may be provided at the other end portion of the first guide member, to distinguish an arrangement direction of the pair of first guide grooves. In this case, the first distinguishing portion may be configured to protrude an outer peripheral portion or recessed from the outer peripheral portion of the other end portion of the first guide member. Thus, the arrangement direction of the pair of first guide grooves can be easily distinguished. Similarly, a second distinguishing portion may be provided at the other end portion of the second distinguishing portion, to distinguish an arrangement direction of the pair of second guide grooves. In this case, the second distinguishing portion may be configured to protrude an outer peripheral portion or recessed from the outer peripheral portion of the other end portion of the second guide member. Thus, the arrangement direction of the pair of second guide grooves can be easily distinguished.

Alternatively/Furthermore, the one end portion of the first guide member may have a cutout portion from which the protrusion portion of the partition member of the first guide member protrudes in the axial direction, and the one end portion of the second guide member may have a cutout portion, which is engaged with the cutout portion of the first guide member when the protrusion portion of the first partition portion at the one end portion of the first guide member is fitted with the recess portion of the second partition portion at the one end portion of the second guide member. Thus, the one end portion of the first guide member can easily correctly contact the one end portion of the second guide member.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

Figure 1:
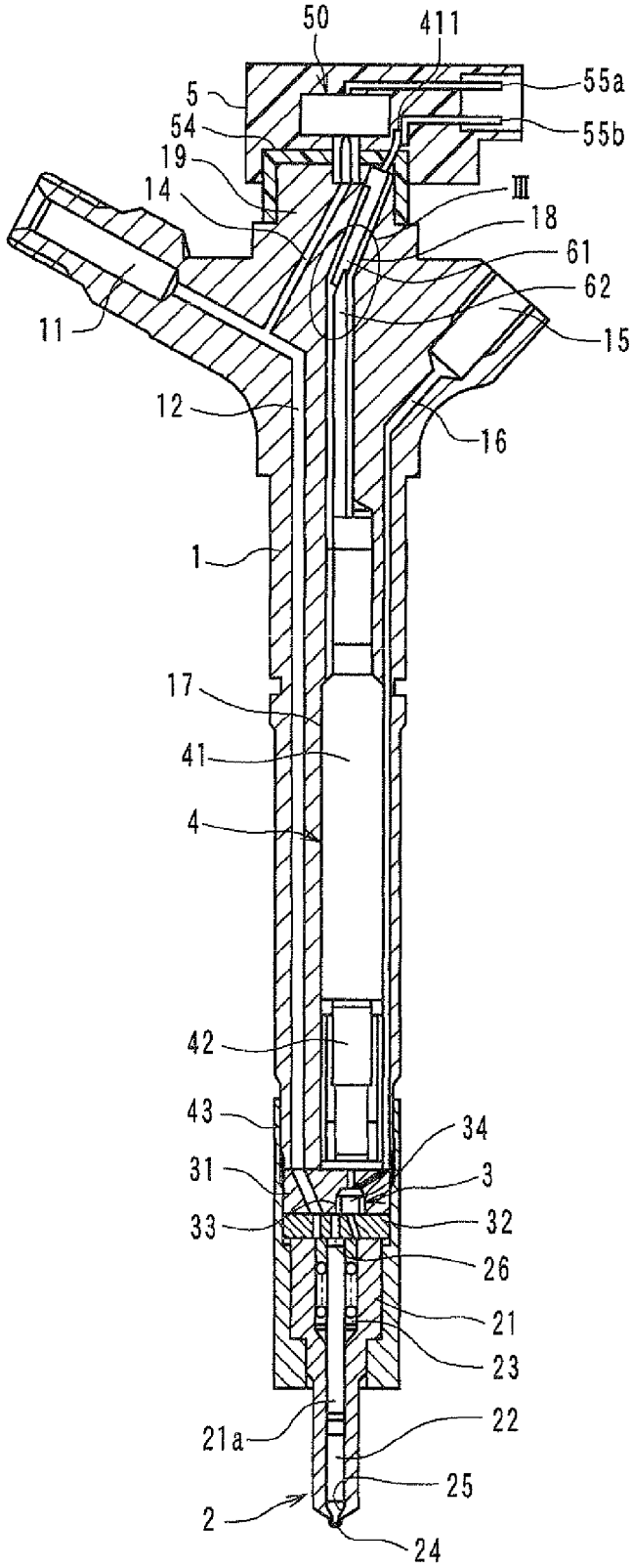
FIG. 1 is a cross sectional view showing a fuel injection device according to an embodiment of the present invention.

An embodiment of the present invention will de described with reference to FIGS. 1 to 5B. FIG. 1 shows an entire structure of a fuel injection device according to the embodiment. The fuel injection device is attached to a header of a cylinder in an internal combustion engine (e.g., diesel engine), so as to inject high-pressure fuel accommodated in a common rail to the cylinder of the internal combustion engine.

The fuel injection device includes a body portion 1 which is formed by forging or cutting a metal member of an iron alloy, for example. The body portion 1 of the fuel injection device is provided with a fuel inlet portion 11, a high-pressure fuel passage 12, a high-pressure fuel branch passage 14, a fuel outlet portion 15, a low-pressure fuel passage 16, a cylindrical receiving hole 17, and a cylindrical lead wire hole 18. High-pressure fuel from the common rail is introduced into the fuel inlet portion 11, and the high-pressure fuel introduced into the fuel inlet portion 11 is supplied to a nozzle 2 via the high-pressure fuel passage 12. The nozzle 2 is arranged at one end side of the body portion 1 in an axial direction.

The high-pressure fuel branch passage 14 is branched from the high-pressure fuel passage 12, so that the high pressure fuel in the high-pressure fuel passage 12 is introduced into a pressure sensor 50. The fuel outlet portion 15 is provided to flow out excess fuel in the fuel injection device toward a fuel tank (not shown). The low-pressure fuel passage 16 is provided in the body portion 1 so that the excess fuel in the fuel injection device flows to the fuel outlet portion 15 via the low-pressure fuel passage 16. An actuator 4 is received in the cylindrical receiving hole 17. In the present embodiment, the lead wire hole 18 is provided so that lead wires 411 of the actuator 4 are guided and introduced to exterior.

The nozzle 2, which is arranged at the one end side of the body portion 1 in the axial direction, injects the fuel, when the nozzle 2 is opened. The nozzle 2 includes a nozzle body 21 having an approximately cylindrical shape, a nozzle needle 22 held slidbly in the nozzle body 21, and a nozzle spring 23 causing the nozzle needle 22 to be biased in a valve closing direction.

Injection holes 24 are provided at one end portion of the nozzle body 21 in the axial direction, to communicate with the fuel inlet portion 11 via the high-pressure fuel passage 12, so that high-pressure fuel can be injected to the cylinder of the internal combustion engine from the injection holes 24. A taper-shaped valve seat 25 is provided in the nozzle body 21 at an immediately upstream side of the injection holes 24, and a seat portion provided at a tip end portion of the nozzle needle 22 is seated on or separated from the valve seat 25, thereby opening and closing the injection holes 24 of the nozzle 2.

A control chamber 26 is provided in the nozzle body 21 at a rear end side of the nozzle needle 22, so as to switch the fuel pressure therein between a high pressure and a low pressure. The nozzle needle 22 is biased in a valve closing direction by the fuel pressure in the control chamber 26, and is biased in a valve opening direction by a high pressure fuel introduced from the fuel inlet portion 11 toward the injection holes 24 via the high-pressure fuel passage 12.

A control valve 3 is disposed between the body portion 1 and the nozzle 2, to control the pressure of the control chamber 26. The control valve 3 is provided with a valve chamber 33 defined by a first plate 31 and a second plate 32. A valve body 34 is accommodated in the valve chamber 33. The body portion 1, the nozzle 2, the first plate 31 and the second plate 32 are connected tightly by a retaining nut 43.

The valve chamber 33 is provided to always communicate with the control chamber 26. The valve chamber 33 is capable of communicating with the low-pressure fuel passage 16 and the high-pressure fuel passage 12. Specifically, the valve body 34 is configured to switch a communication between the valve chamber 33 and the low-pressure fuel passage 16, or between the valve chamber 33 and the high-pressure fuel passage 12.

The actuator 4 drives the valve body 34 in accordance with an electrical signal input from the exterior, so as to control the pressure of the control chamber 26 and control opening and closing operation of the nozzle 2. The actuator 4 includes a cylindrical piezo actuator 41 displaceable by extending or contracting, and a transmission portion 42 through which the extending or contracting displacement of the piezo actuator 41 is transmitted to the valve body 34. The control valve 3 and the actuator 4 are arranged to configure a pressure control portion in the present embodiment.

Figure 2:
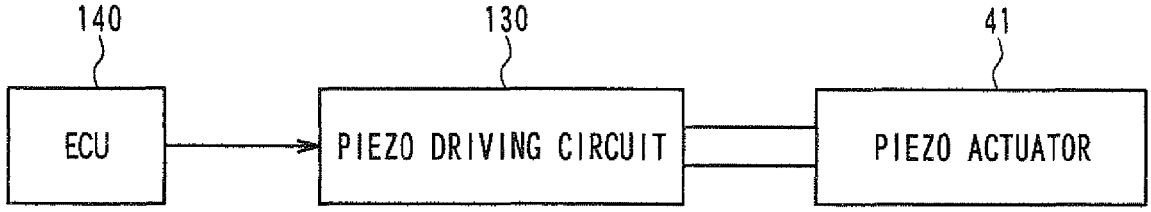
FIG. 2 is a block diagram showing an injection control of the fuel injection device.

Electrical power is supplied to the piezo actuator 41 via a piezo driving circuit 130 shown in FIG. 2. The piezo driving circuit 130 is configured to control voltage applied to the piezo actuator 41, thereby changing an extending or contracting amount of the piezo actuator 41. The piezo driving circuit 130 is controlled by an electronic control unit (ECU) 140, so as to control electrical voltage applied to the piezo actuator 41 and an electricity supplying timing to the piezo actuator 41.

The ECU 140 is configured by a microcomputer including CPU, ROM, flash memory, RAM and the like. The CPU performs a calculation process in accordance with program stored in the ROM. Various signals are input to the ECU 140. For example, an intake air amount, a pedaled amount of an accelerator pedal, a rotational speed of the internal combustion engine, and signals from various sensors are input to the ECU 40.

In the present embodiment, the body portion 1 of the fuel injection device is provided with the lead wire hole 18 through which a pair of lead wires 411 connected to the piezo actuator 41 can be introduced to the exterior. The pair of lead wires 411 corresponds to lead wires connected to the pressure control portion 3, 4, in the present embodiment. As shown in FIG. 1, the lead wire hole 18 is bent at a portion within the body portion 1. A first guide member 61 is inserted from one end side (e.g., upper side in FIG. 1) of the lead wire hole 18, and a second guide member 62 is inserted into the other end side (e.g., lower side in FIG. 1) of the lead wire hole 18, so that one end portion of the first guide member 61 contacts one end portion of the second guide member 62. For example, the first and second guide members 61, 62 are made of resin (e.g., nylon) having a sufficient strength.

A cover member 54 is fitted with a protrusion portion 19 of the body portion 1, so as to prevent a material such as the fuel, oil or water from being introduced into an interior of the pressure sensor 50 or from being introduced into the lead wire hole 18.

Plural first terminals 55*a* (e.g., four first terminals) are disposed to be bonded to respective electrodes provided on the surface of the pressure sensor 50 by welding. In FIG. 1, only one first terminal 55*a* is indicated.

Plural second terminals 55*b* (e.g., two second terminals) are disposed to be bonded to respective electrodes provided on the piezo actuator 41 by welding. In FIG. 1, only one terminal 55*b* is indicated.

The first terminals 55*a* and the second terminals 55*b* are accommodated in the same connector housing. The connector housing and the ECU 140 are wired by using a single connector cable.

Figure 3:
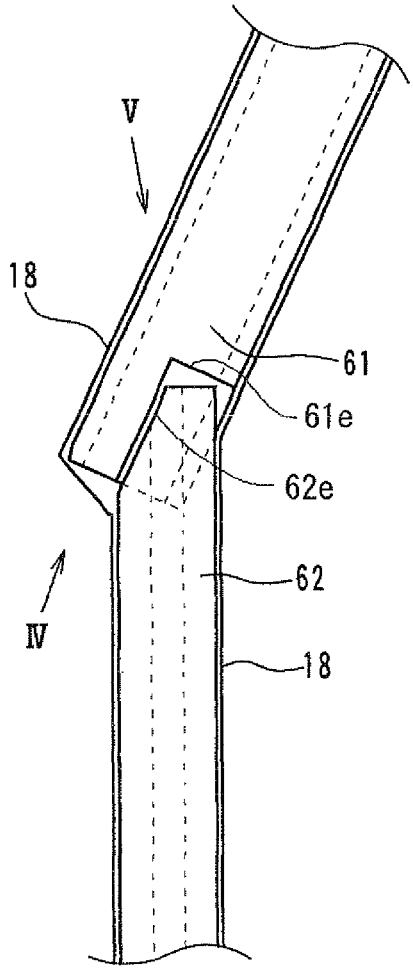
FIG. 3 is an enlarged view showing the part indicated by III in the fuel injection device of FIG. 1.

FIG. 3 is an enlarged view showing the part III in FIG. 1. As shown in FIG. 3, the one end portion of the first guide member 61 is fitted with the one end portion of the second guide member 62, so that the one end portion of the first guide member 61 contacts the one end portion of the second guide member 62.

Figure 4A:
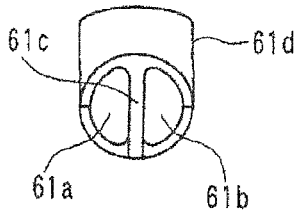
FIG. 4A is a view showing a first guide member when being viewed from arrow IV in FIG. 3.
Figure 4B:
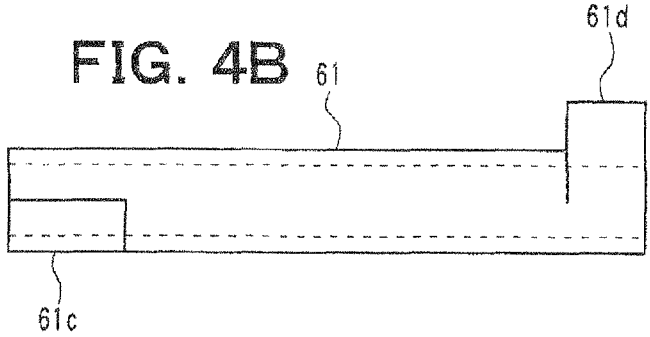
FIG. 4B is a side view showing the first guide member in FIG. 4A, according to the embodiment.

FIGS. 4A and 4B show the configuration of the first guide member 61. FIG. 4A is a view when being viewed from the arrow IV in FIG. 3 before the second guide member 62 is connected to the first guide member 61, and FIG. 43 is a side view of FIG. 4A.

A pair of guide grooves 61*a*, 61*b* extending respectively in a longitudinal direction (axial direction) of the cylindrical first guide member 61 are provided in the first guide member 61. A partition member 61*c* is disposed in the first guide member 61 to separate the guide grooves 61*a*, 61*b* from each other. A part of an outer periphery of the first guide member 61 having therein the guide grooves 61*a*, 61*b* is cut from the one end portion of the first guide member 61 by a predetermined length, thereby forming a cutout portion 61*e*. In the example of FIG. 3, a half part of the cylindrical outer periphery of the first guide member 61 is cut from the one end portion of the first guide member 61 by a predetermined length, so as to form the cutout portion 61*e*. Therefore, the partition member 61*c* protrudes from the cutout portion 61*e* in the axial direction of the first guide member 61.

As shown in FIG. 4B, a protrusion portion 61*d* is provided at the other end portion of the first guide member 61 to protrude from the outer periphery of the first guide member 61. The protrusion portion 61*d* is located to distinguish an arrangement direction of the guide grooves 61*a*, 61*b* in the first guide member 61. Thus, the protrusion portion 61*d* is used as a distinguishing portion for distinguishing the arrangement direction of the guide grooves 61*a*, 61*b*.

Figure 5A:
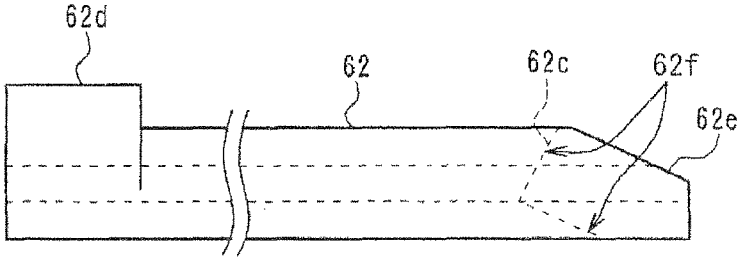
FIG. 5A is a side view showing a second guide member.
Figure 5B:
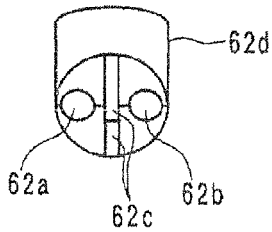
FIG. 5B is a view showing the second guide member when being viewed from arrow V in FIG. 3, according to the embodiment.
Figure 6:
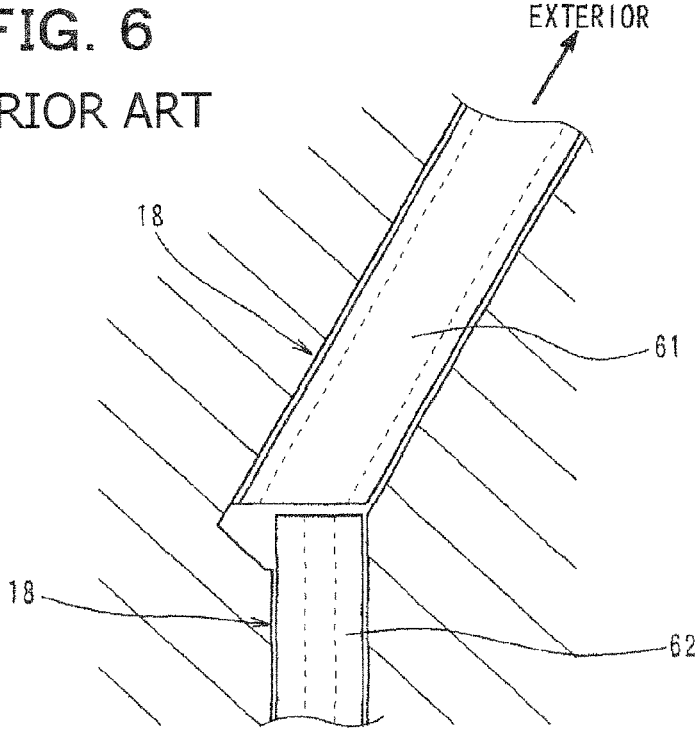
FIG. 6 PRIOR ART
FIG. 6 is a schematic diagram showing a first guide member and a second guide member in a comparison example.

FIGS. 5A and 5B show the configuration of the second guide member 62. FIG. 5B is a view when being viewed from the arrow V in FIG. 3 before the first guide member 61 is connected to the second guide member 62, and FIG. 5A is a side view of FIG. 5B.

A pair of guide grooves 62*a*, 62*b* extending respectively in a longitudinal direction (axial direction) of the cylindrical second guide member 62 are provided in the second guide member 62. A partition member 62*c* is disposed in the second guide member 62 to separate the guide grooves 62*a*, 62*b* from each other. A recess portion 62*f* is provided at an end portion of the partition member 62*c* to be recessed from the one end portion of the second guide member 62. The recess portion 62*f* of the partition member 62*c* in the second guide member 62 is provided to be engaged with the protrusion portion of the partition member 61*c* protruded from the cutout portion 61*e* in the first guide member 61.

As shown in FIG. 5A, a protrusion portion 62*d* is provided at the other end portion of the second guide member 62 to protrude from the outer periphery of the second guide member 62. The protrusion portion 62*d* is located to distinguish an arrangement direction of the guide grooves 62*a*, 62*b*, in the second guide member 62. Thus, the protrusion portion 62*d* is used as a distinguishing portion for distinguishing the arrangement direction of the guide grooves 62*a*, 62*b*.

A cutout portion 62*e* is provided at the one end portion of the second guide member 62, so that the one end portion of the second guide member 62 can be fitted with the cutout portion 61*e* of the first guide member 61, as shown in FIG. 3. The cutout portion 62*e* is provided such that the radial dimension of the one end portion of the second guide member 62 gradually becomes smaller as toward its tip end.

The second guide member 62 is arranged at a side near the piezo actuator 41, and the first guide member 61 is arranged at a side separate from the piezo actuator 41. Each hole diameter of the guide grooves 62*a*, 62*b* provided in the second guide member 62 is smaller than each hole diameter of the guide grooves 61*a*, 61*b* provided in the first guide member 61.

The two lead wires 411 connected to the piezo actuator 41 protrude to the exterior from the lead wire hole 18, via the pair of guide grooves 62*a*, 62*b* of the second guide member 62 and the pair of guide grooves 61*a*, 61*b* of the first guide member 61. Specifically, one of the two lead wires 411 protrudes to the exterior from the lead wire hole 18 via the guide groove 62*a* of the second guide member 62 and the guide groove 61*a* of the first guide member 61. The other one of the two lead wires 411 protrudes to the exterior from the lead wire hole 18 via the guide groove 62*b* of the second guide member 62 and the guide groove 61*b* of the first guide member 61. Each of the two lead wires 411 of the piezo actuator 41 are covered by an insulation cover, except for a tip end portion, for example.

Next, process of assembling the components including the piezo actuator 41, to the body portion 1, will be described.

First, the first guide member 61 is inserted from one end side (e.g., upper side in FIG. 1) of the lead wire hole 18, such that the protrusion portion 61*d* provided at the other end side of the first guide member 61 is positioned at a set position (e.g., left side in FIG. 1).

Next, the two lead wires 411 of the piezo actuator 41 are respectively inserted into a midway position of the second guide member 62 in the longitudinal direction. At this state, the second guide member 62 is inserted from the other end side (lower side in FIG. 1) of the lead wire hole 18. That is, the second guide member 62 is inserted from the other end side of the lead wire hole 18, while having therein the inserted two lead wires 411 of the piezo actuator 41. The second guide member 62 is inserted from the other end side of the lead wire hole 18, such that the protrusion portion 62*d* is positioned at a set position (e.g., right side in FIG. 1).

Thus, the partition member 61*c* of the first guide member 61 exposed from the cutout portion 61*e* is fitted with the recess portion 62*f* of the partition member 62*c* of the second guide member 62, so that the one end portion of the first guide member 61 contacts the one end portion of the second guide member 62. In the present embodiment, the cutout portion 62*e* is provided at the one end portion of the second guide member 62, so that the one end portion of the second guide member 62 is fitted with the cutout portion 61*e* provided at the one end side of the first guide member 61.

Then, the two lead wires 411 of the piezo actuator 41 are further inserted into the second guide member 62, so that the two lead wires 411 of the piezo actuator 41 are respectively introduced from the guide grooves 62*a*, 62*b* of the second guide member 62 into the guide grooves 61*a*, 61*b* of the first guide member 61, and protrude to the exterior from the lead wire hole 18.

In the present embodiment, the partition member 61*c* of the first guide member 61 is a partition wall exposed from the cutout portion 61*e* of the first guide member 61, and is fitted with the recess portion 62*f* of the partition member 62*c* of the second guide member 62. Therefore, it can prevent the arrangement positions of the two lead wires 411 are changed and switched when the two lead wires 411 are introduced from the second guide member 62 to the first guide member 61, and thereby the two lead wires 411 can be correctly inserted into the guide grooves 61*a*, 61*b* of the first guide member 61 from the guide grooves 62*a*, 62*b* of the second guide member 62.

In the present embodiment, the partition member 61*c* of the first guide member 61, exposed from the cutout portion 61*e*, is fitted with the recess portion 62*f* of the partition member 62*c* in the second guide member 62. Thus, if the arrangement positions of the lead wires 411 are switched, the first guide member 61 is pressed largely to the upper side, or the length of the lead wires 411 protruding to the exterior is greatly shortened. Thus, by confirming whether the first guide member 61 is greatly pressed or whether the length of the lead wires 411 exposed to the exterior is greatly short, an incorrect insertion of the lead wires 411 can be distinguished.

Next, the actuator 4 is received in the receiving hole 17. Thereafter, the body portion 1, the nozzle 2, the first plate 31 and the second plate 32 are connected to each other by using the retaining nut 43.

Next, the cover member 54 is fitted with the protruding portion 19 of the body portion 1, so that the pressure sensor 50 is fixed to the protrusion portion 19 of the body portion 1.

Then, the respective electrodes provided on the top surface of the pressure sensor 50 are welted to the terminals 55*a*, and the two lead wires 411 of the piezo actuator 41 are welted respectively to the terminals 55*b*.

The pressure sensor 50 and the cover member 54 are molded integrally by using a resin material, so as to form an integrated connector 5. Thus, the connector 5 including a connector housing is formed at the other end side of the body portion 1, opposite to the nozzle 2.

Next, operation of the fuel injection device will be described. When electrical charge of the piezo actuator 41 is performed, the piezo actuator 41 is extended, so that the valve body 34 is driven toward the lower side in FIG. 1 via the transmission portion 42. Because the valve body 34 is driven, the valve chamber 33 communicates with the low-pressure fuel passage 16, and a communication between the valve chamber 33 and the high pressure fuel passage 12 is shut.

Thus, the control chamber 26 communicates with the low-pressure fuel passage 16 via the valve chamber 33. Thus, the pressure of the control chamber 26 is reduced, thereby reducing the force for biasing the nozzle needle 22 toward the valve closing direction. In this case, the nozzle needle 22 is moved in a valve open direction, the seat portion of the nozzle needle 22 is separated from the valve seat 25 of the seal portion to open the injection holes 24, and fuel is injected from the injection holes 24 into the cylinder of the internal combustion engine.

When electrical discharge of the piezo actuator 41 is performed, the piezo actuator 41 is contracted, so that the valve body 34 is driven toward the upper side in FIG. 1 via the transmission portion 42. Because the valve body 34 is driven, the valve chamber 33 communicates with the high-pressure fuel passage 12, and a communication between the valve chamber 33 and the low pressure fuel passage 16 is shut.

Thus, the control chamber 26 communicates with the high-pressure fuel passage 12 via the valve chamber 33. Thus, the pressure of the control chamber 26 is increased, thereby increasing the force for biasing the nozzle needle 22 toward the valve closing direction. In this case, the nozzle needle 22 is moved in the valve closing direction, the seat portion of the nozzle needle 22 contacts the valve seat 25 of the seal portion to close the injection holes 24, and the fuel injection from the injection holes 24 into the cylinder of the internal combustion engine is ended.

In the present embodiment, the partition member 61*c* is provided in the first guide member 61 to partition the pair of guide grooves 61*a*, 61*b* from each other, and the partition member 62*c* is provided in the second guide member 62 to partition the pair of guide grooves 62*a*, 62*b* from each other. The partition member 61*c* at the one end side of the first guide member 61 is fitted with the recess portion 62*f* of the one end side of the partition member 62*c* in the second guide member 62, so that the one end portion of the first guide member 61 contacts the one end portion of the second guide member 62. In addition, the cutout portion 62*e* is provided at the one end portion of the second guide member 62 to be engaged with the cutout portion 61*e* of the first guide member 61. Therefore, the one end portion of the second guide member 62 can be correctly inserted to the cutout portion 61*e*, and can be correctly fitted with the one end portion of the first guide member 61. Thus, an incorrect insertion of the lead wires at the contact portion between the first and second guide members 61, 62 can be effectively prevented. Furthermore, even if an incorrect insertion of the lead wires is caused at the contact portion between the first and second guide members 61, 62, the incorrect insertion can be easily distinguished.

Furthermore, the guide grooves 61*a*, 61*b* of the first guide member 61 arranged far from the pressure control portion 3, 4 have the hole diameter larger than the hole diameter of the guide grooves 62*a*, 62*b* of the second guide member 62 arranged close to the pressure control portion 3, 4. Therefore, the lead wires 411 connected to the pressure control portion 3, 4 can smoothly pass through the contact portion between the first guide member 61 and the second guide member 62.

Because the protrusion portion 61*d* protruding outside from the peripheral surface at the other end portion of the first guide member 61 is used as a distinguishing portion, the arrangement direction of the guide grooves 61*a*, 61*b* can be easily distinguished. Thus, when the first guide member 61 is inserted into the lead wire hole 18, the arrangement direction of the guide grooves 61*a*, 61*b* can be easily set at a predetermined arrangement direction.

Because the protrusion portion 62*d* protruding outside from the peripheral surface at the other end portion of the second guide member 62 is used as a distinguishing portion, the arrangement direction of the guide grooves 62*a*, 62*b* can be easily distinguished. Thus, when the first guide member 62 is inserted into the lead wire hole 18, the arrangement direction of the guide grooves 62*a*, 62*b* can be easily set at a predetermined arrangement direction.

Although the present invention has been fully described in connection with the preferred embodiments thereof with reference to the accompanying drawings, it is to be noted that various changes and modifications will become apparent to those skilled in the art.

For example, the first guide member 61 having the partition member 61*c* used as a protrusion portion is located at an upper side far from the pressure control portion 3, 4, and the second guide member 62 having the recess portion 62*f* of the partition member 62*c* is located at a lower side near the pressure control portion 3, 4. However, the first guide member 61 having the partition member 61*c* used as a protrusion portion may be located at a lower side near the pressure control portion 3, 4, and the second guide member 62 having the recess portion 62*f* of the partition member 62*c* may be located at an upper side far from the pressure control portion 3, 4. In this case, the lead wires 411, connected to the pressure control portion 3, 4, are introduced from the first guide member 61 to the second guide member 62

In the above embodiment, the protrusion portions 61*d*, 62*d* are used as the distinguishing portions for distinguishing the arrangement direction of the guide grooves 61*a*, 61*b* or the guide grooves 62*a*, 62*b*. However, as the distinguishing portion, a recess portion recessed radially inside from the peripheral surface at the other end portion of the first guide member 61 or the second guide member 62 may be used. Alternatively, an uneven portion provided at the other end portion of the first or second guide member 61, 62 may be used as the distinguishing portion.

In the above-described embodiment, the present invention is typically applied to the fuel injection device having the piezo actuator 41 as the actuator for driving the nozzle 2. However, the present invention may be applied to a solenoid fuel injection device using a solenoid as an actuator for driving the nozzle 2.

In the above embodiment, the cutout portion 61*e* is provided at the one end portion of the first guide member 61 so that the partition member 61*c* protrudes from the one end portion of the first guide member 61, and the cutout portion 62*e* is provided at the one end portion of the second guide member 62 so that the one end portion of the second guide member 62 is engaged with the one end portion of the first guide member 61. However, if the partition member 61*c* protruding from the one end portion of the first guide member 61 is fitted with the recess portion 62*f* of the partition member 62*c* of the second guide member 62, the shapes of the one end portions of the first and second guide members 61, 62 can be suitably changed.

Such changes and modifications are to be understood as being within the scope of the present invention as defined by the appended claims.

What is claimed is:

1. A fuel injection device comprising:

a nozzle configured to inject high pressure fuel from injection holes;

a pressure control unit configured to control operation of the nozzle in accordance with an electrical signal input from an exterior;

a body having therein a lead wire hole through which two lead wires connected to the pressure control portion are introduced to the exterior, the lead wire hole having a bend defined at an intermediate position along a length thereof;

a first guide member having therein a pair of first guide bores extending in an axial direction of the first guide member, the first guide member being inserted into the lead wire hole from one end of the lead wire hole;

a second guide member having therein a pair of second guide bores extending in an axial direction of the second guide member, the second guide member being inserted into the lead wire hole from the other end of the lead wire hole;

a first partition member provided in the first guide member to partition the first guide bores from each other, the first partition member protruding from one end portion of the first guide member to define a protruding part of the first guide member; and a second partition member provided in the second guide member to partition the second guide bores from each other, the second partition member being recessed from one end portion of the second guide member to define a recess portion of the second guide member, wherein the protruding part of the first guide member is fitted with the recess portion of the second guide member, so that the one end of the first guide member contacts the one end of the second guide member at said bend defined at said intermediate position along the length of said lead wire hole, such that said axial direction of the first guide member is inclined with respect to said axial direction of the second guide member, and the two lead wires connected to the pressure control portion protrude toward the exterior respectively via the first and second guide bores the first and second guide members.

2. The fuel injection device according to claim 1, wherein the first guide member is located at a position remote from the pressure control portion, the second guide member is located proximate the pressure control portion, and a hole diameter of each first guide bore provided in the first guide member is larger than a hole diameter of each second guide bore provided in the second guide member.

3. The fuel injection device according to claim 1, further comprising a first protrusion portion provided at an other end of the first guide member, to distinguish an arrangement direction of the pair of first guide bores, wherein the first protrusion portion is configured to protrude radially outwardly from an outer peripheral portion the other end of the first guide member.

4. The fuel injection device according to claim 1, further comprising a second protrusion portion provided at an other end of the second guide member, to distinguish an arrangement direction of the pair of second guide bores, wherein the second protrusion portion is configured to protrude radially outwardly from an outer peripheral portion of the other end of the second guide member.

5. The fuel injection device according to claim 1, wherein the one end of the first guide member has a cutout portion from which the partition member of the first guide member protrudes in the axial direction as the protruding part of the first guide member, and the one end of the second guide member is engaged with the cutout portion of the first guide member when the protruding part of the first guide member is fitted with the recess portion of the second guide member.

* * * * *